US007050727B2

(12) United States Patent
Chihara

(10) Patent No.: US 7,050,727 B2
(45) Date of Patent: May 23, 2006

(54) STORAGE CONTROL METHOD FOR A MEMORY PROVIDED IN A REMOVABLE CARTRIDGE IN AN IMAGE FORMING APPARATUS

(75) Inventor: Hiroshi Chihara, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/201,315

(22) Filed: Aug. 11, 2005

(65) Prior Publication Data

US 2006/0034628 A1 Feb. 16, 2006

Related U.S. Application Data

(62) Division of application No. 10/446,100, filed on May 28, 2003.

(30) Foreign Application Priority Data

Jun. 7, 2002 (JP) ..... 2002-167656

(51) Int. Cl.
*G03G 15/00* (2006.01)

(52) U.S. Cl. ..... 399/12; 399/25; 399/27; 399/111

(58) Field of Classification Search ..... 399/12, 399/24, 25, 27, 31, 110, 111, 119, 120; 711/162; 707/204
See application file for complete search history.

(56) References Cited

U.S. PATENT DOCUMENTS

| | | | | |
|---|---|---|---|---|
| 4,774,544 | A * | 9/1988 | Tsuchiya et al. | 399/24 |
| 5,150,462 | A | 9/1992 | Takeda et al. | 395/166 |
| RE35,751 | E | 3/1998 | Midgley | 399/25 |
| 5,778,406 | A | 7/1998 | Willard | 711/1 |
| 6,163,658 | A | 12/2000 | Suzuki | 399/12 |
| 6,360,231 | B1 | 3/2002 | Pong et al. | 707/201 |
| 6,421,137 | B1 | 7/2002 | Endo | 358/1.16 |
| 6,473,059 | B1 | 10/2002 | Yasue | 345/3.1 |
| 6,532,551 | B1 * | 3/2003 | Kamei et al. | 714/13 |
| 6,631,248 | B1 | 10/2003 | Serizawa | 399/27 |
| 6,694,106 | B1 | 2/2004 | Yoshimura | 399/12 |
| 6,708,005 | B1 | 3/2004 | Chihara | 399/12 |
| 2002/0018657 | A1 | 2/2002 | Serizawa | 399/27 |
| 2002/0127021 | A1 | 9/2002 | Chihara | 399/12 |

FOREIGN PATENT DOCUMENTS

| | | | |
|---|---|---|---|
| EP | 1 089 133 | | 4/2001 |
| EP | 1 211 575 | | 6/2002 |
| JP | 09190137 | A | 7/1997 |
| JP | 10052964 | A * | 2/1998 |
| JP | 11031107 | A * | 2/1999 |
| JP | 2001195313 | A * | 7/2001 |
| JP | 2002067449 | A * | 3/2002 |

* cited by examiner

*Primary Examiner*—Robert Beatty
(74) *Attorney, Agent, or Firm*—Fitzpatrick, Cella, Harper & Scinto

(57) ABSTRACT

An image forming apparatus in which a memory has a first storage area for storing information related to image formation as predetermined unit data and a second storage area (back-up memory) for storing the information as bit-unit data. A printer control unit, which controls writing/reading of the information related to image formation to/from the memory, stores the information related to image formation, stored in the first storage area as the predetermined unit data as the bit-unit data, into said second storage area.

6 Claims, 12 Drawing Sheets

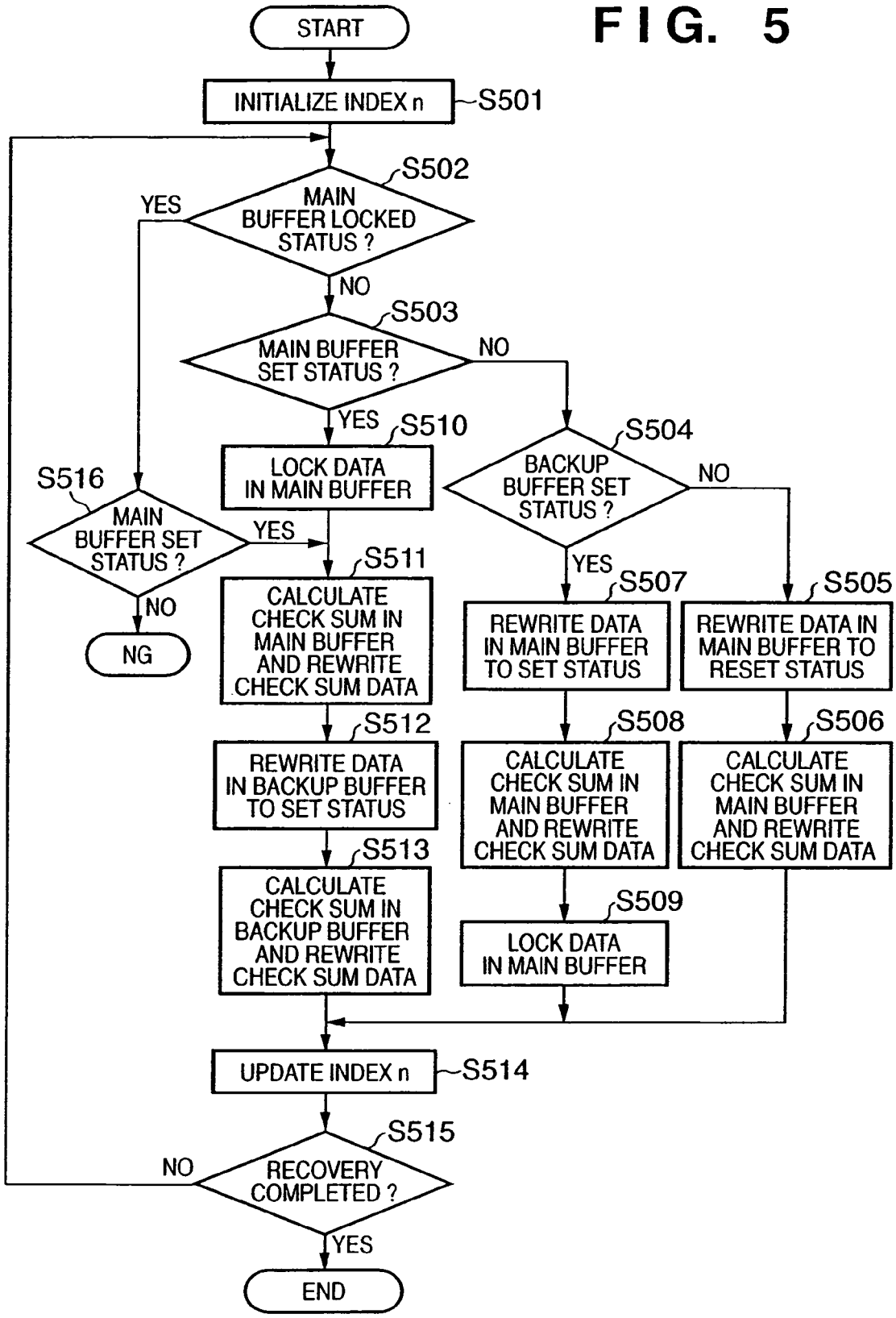
FIG. 5
START
INITIALIZE INDEX n
S501
S502
MAIN BUFFER LOCKED STATUS ?
YES
NO
S503
MAIN BUFFER SET STATUS ?
NO
YES
S510
LOCK DATA IN MAIN BUFFER
S504
BACKUP BUFFER SET STATUS ?
NO
YES
S516
MAIN BUFFER SET STATUS ?
YES
NO
NG
S511
CALCULATE CHECK SUM IN MAIN BUFFER AND REWRITE CHECK SUM DATA
S507
REWRITE DATA IN MAIN BUFFER TO SET STATUS
S505
REWRITE DATA IN MAIN BUFFER TO RESET STATUS
S512
REWRITE DATA IN BACKUP BUFFER TO SET STATUS
S508
CALCULATE CHECK SUM IN MAIN BUFFER AND REWRITE CHECK SUM DATA
S506
CALCULATE CHECK SUM IN MAIN BUFFER AND REWRITE CHECK SUM DATA
S513
CALCULATE CHECK SUM IN BACKUP BUFFER AND REWRITE CHECK SUM DATA
S509
LOCK DATA IN MAIN BUFFER
UPDATE INDEX n
S514
S515
RECOVERY COMPLETED ?
NO
YES
END

STORAGE CONTROL METHOD FOR A MEMORY PROVIDED IN A REMOVABLE CARTRIDGE IN AN IMAGE FORMING APPARATUS

CROSS REFERENCE TO RELATED APPLICATION

This application is a divisional application of application Ser. No. 10/446,100, filed May 28, 2003, pending.

FIELD OF THE INVENTION

The present invention relates to an image forming apparatus to which a cartridge for an image formation process is removably attached, the cartridge, a memory mounted on the cartridge, a memory control method, a program and a storage medium.

BACKGROUND OF THE INVENTION

Conventionally, in a copier, a laser-beam printer or the like using an electrophotographic technology, an image forming apparatus where various image forming elements are provided as a unit and removably attached to the apparatus main body has been provided. When the life of the unit has expired, it is exchanged with a new one. The image forming apparatus is managed in this manner.

As shown in FIG. 10, the unit used for image formation is a cartridge including an electrostatic drum as an image holder, a charging roller as a charging member to uniformly charge the surface of the electrostatic drum, and a developing device including a developing roller and a developing material container as a developing member for supplying toner as developing material to the electrostatic drum. The cartridge is removably attached to the apparatus main body.

In recent years, a cartridge with a nonvolatile memory (e.g., an EEPROM (hereinbelow, "memory")) has been utilized as the above cartridge. The cartridge with a memory holds information on the life of the cartridge, such as the drum revolution accumulated time and the remaining amount of toner. A printer controller judges the life of the toner cartridge based on the information obtained by communication of this information, and determines whether to cancel a print signal from a controller or the like.

Data can be written/read to/from the memory of the cartridge. That is, data writing/reading to/from the memory can be performed based on an instruction from the printer controller. Further, regarding data which has been written into the memory and which will not be rewritten, the data can be set to a rewriting-disabled status (locked). Once the data is locked, thereafter, writing cannot be made and only reading is possible from the corresponding area. Data locking is performed in 1 byte units, 2 byte units, 4 byte units, 40 byte units or the like. Thus a data size lockable at once differs in accordance with the memory.

Further, the lockable data size is not necessarily fixed regarding all the data areas in a memory. In some memories, locking can be performed in 1 byte units in one part or area of the memory, and locking can be performed in 4 byte units in another part. In this manner, the lockable data size differs in this memory.

Among various data structures that may be used for storage into the memory, a double-buffer structure is known as a data structure for improvement of data reliability. The entire data is divided for storage in a main buffer and a backup buffer, and data indicating the same meaning is stored in both buffers, and upon coincidence of the data between the both buffers, corresponding data is utilized as reliable data.

Further, as a method for increasing reliability, a check sum may be provided in respective buffers of the double-buffer structure. In this method, every time data is updated, the check sum is updated and stored. Further, the check sum is checked upon use of memory data during the start-up of the apparatus main body, or the like, and if an abnormality is detected in the check sum, all the data in the buffer where the abnormality has been detected in the check sum is recovered by using data in the buffer where no abnormality has been detected in the check sum, thereby permitting the use of the memory thereafter.

In the above conventional art, the data in the memory can be locked when it is determined that rewriting is not to be performed. But, even if the data indicates only one of 2 bit-representable statuses, data lock is performed on a predetermined unit of area such as 1 byte (8 bits) according to the internal structure of the memory. That is, since the data size must be expanded to a lockable minimum unit, the efficiency of use of the data areas of the memory is lowered, and wasted data areas occur.

Further, in the case where the check sum is provided in the respective buffers of the double-buffer structure, the order of data storage is as follows.

(1) data update in main buffer
(2) check sum update in main buffer
(3) data lock in main buffer
(4) data update in backup buffer
(5) check sum update in backup buffer In the stage (2), if an error occurs, the data in the main buffer is recovered by using the data in the backup buffer. When data rewrite instruction is issued again, data in the corresponding area is rewritten. In a case where interval between issuance of the data rewrite instruction is very long, although data change timing has come once, data rewriting is not performed until the next data change timing comes.

SUMMARY OF THE INVENTION

The present invention has been proposed to solve the above-described conventional problems, and has its object to provide an image forming apparatus which improves the efficiency of use of memory data areas, a cartridge, a memory mounted on the cartridge, a memory control method, a program and a storage medium.

Further, another object of the present invention is, when an abnormality occurs in memory data, to restore the memory status to a status close to the latest status.

According to one aspect of the present invention, the foregoing objects are attained by providing an image forming apparatus for forming an image by using a cartridge having part of the elements for image formation, comprising: a memory having a first storage area for storing information related to image formation as predetermined unit data, and a second storage area for storing the information as bit-unit data; and control means for controlling writing/reading of the information related to image formation to/from the memory, wherein the control means stores information corresponding to the predetermined unit data, as the bit-unit data, into the second storage area.

According to another aspect of the present invention, provided is a memory control method for a memory, provided in a cartridge removably attached to an image forming apparatus main body, having a first storage area for storing predetermined unit data and a second storage area for storing bit-unit data, the method comprising; a first determination step of determining whether or not the first storage area is in a writing-disabled status; a second determination step of, if the first storage area is not in the writing-disabled status, determining whether or not data stored in the first storage area has a default value; and a control step of, if the data stored in the first storage area is not the default value, changing the first storage area to the writing-disabled status.

According to another aspect of the present invention, provided is a cartridge having part of the elements for image formation, which is removably attached to an image forming apparatus main body, comprising: a memory having: a first storage area for storing information related to image formation as predetermined unit data; and a second storage area for storing information corresponding to the predetermined unit data as bit-unit data.

Other features and advantages of the present invention will be apparent from the following description taken in conjunction with the accompanying drawings, in which like reference characters designate the same name or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

FIG. 5 is a flowchart showing data recovery processing according to the present invention;

DETAILED DESCRIPTION OF THE PREFERRED EMBODIMENTS

Figure 1:
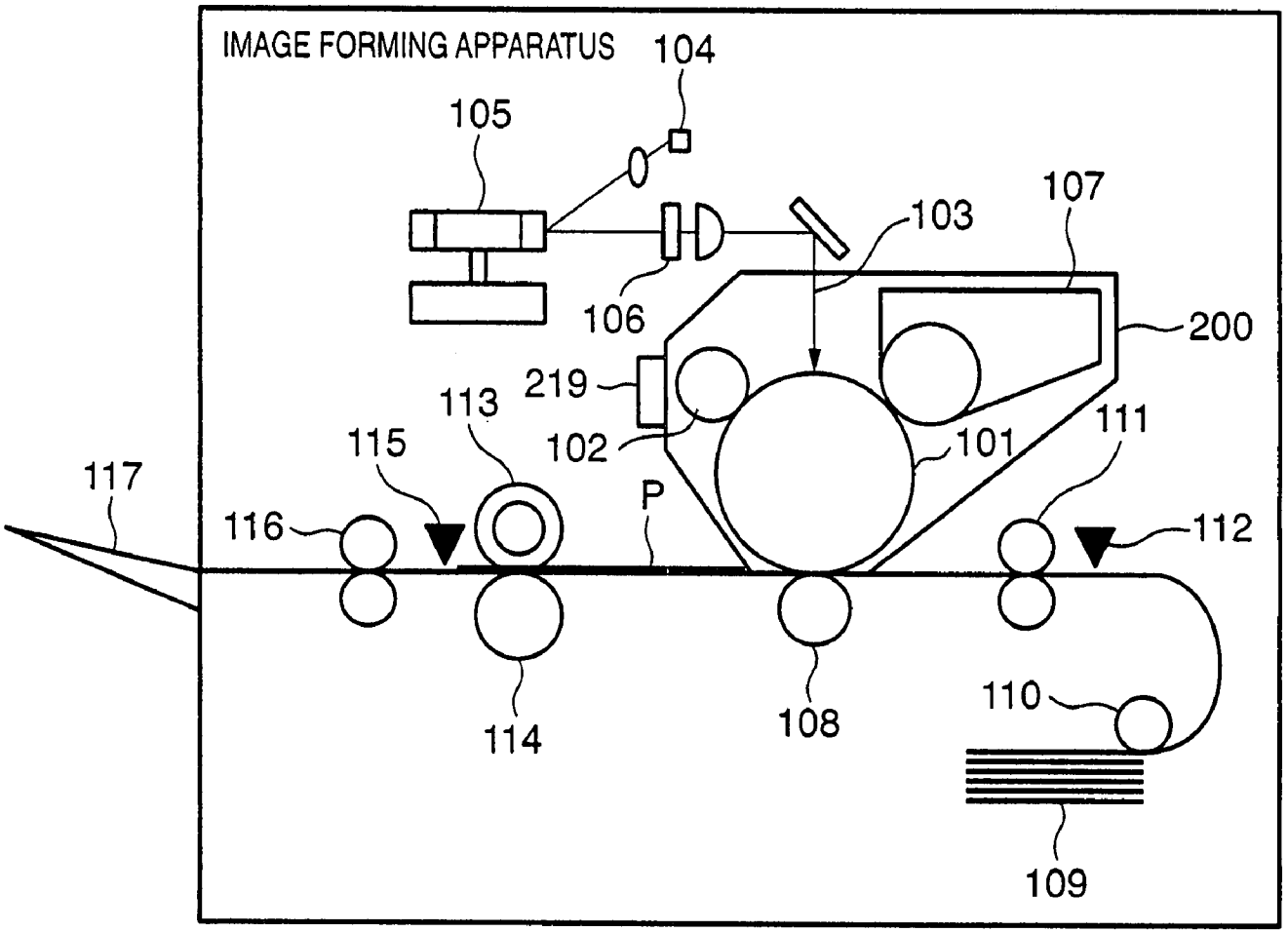
FIG. 1 is a schematic cross-sectional view showing the structure of a general laser printer using electrophotographic technology.
Figure 2:
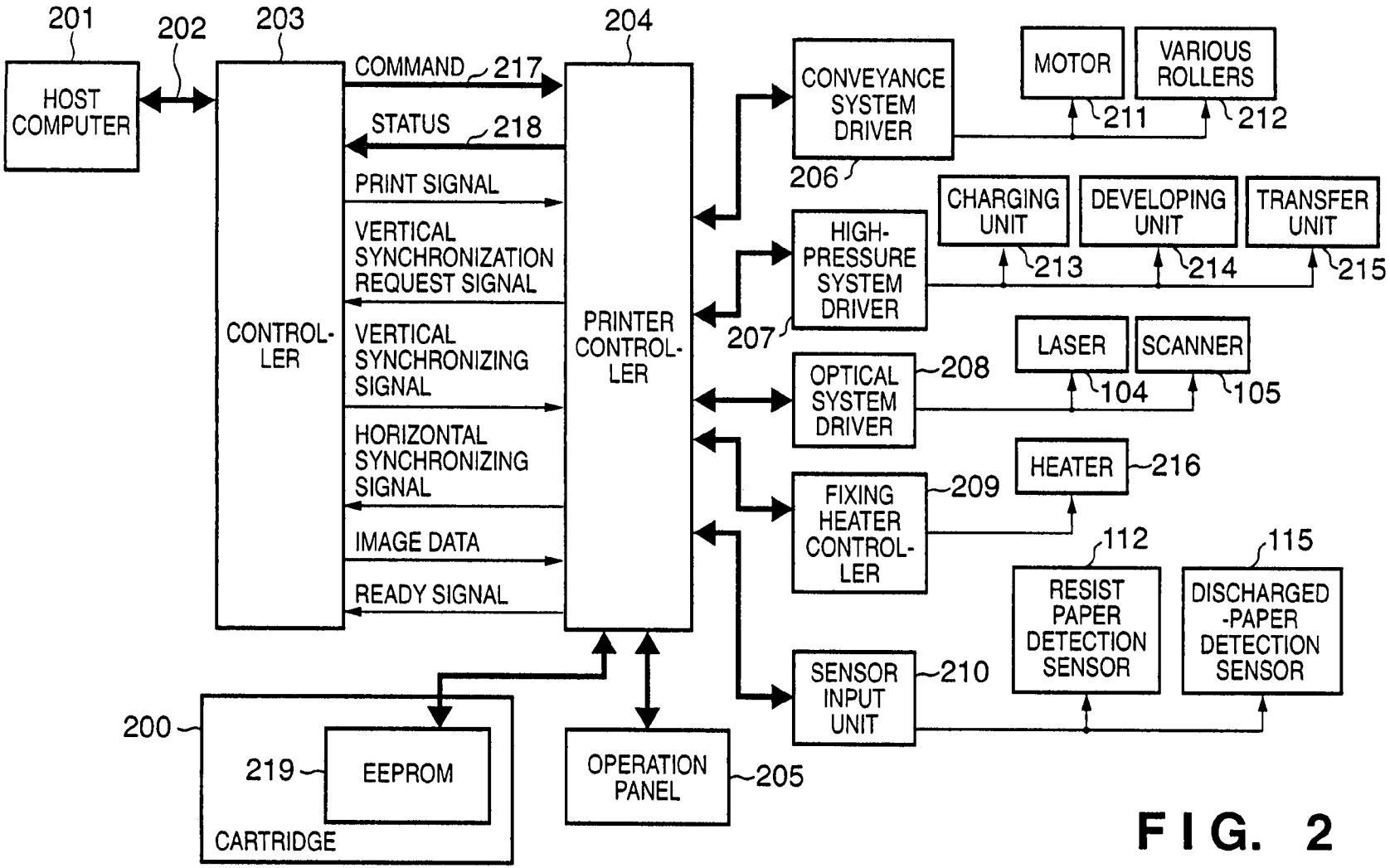
FIG. 2 is a block diagram showing the construction of a controller of the laser printer in FIG. 1.

Preferred embodiments of the present invention will now be described in detail with reference to the drawings (FIGS. 1 and 2).

FIG. 1 is a schematic cross-sectional view showing the structure of a laser printer using the electrophotographic technology to which the present invention is applicable. In FIG. 1, reference numeral 101 denotes an electrostatic drum as a latent image holder. A charging roller 102, which uniformly charges the surface of the electrostatic drum 101, is positioned above the drum in contact with the surface of the drum. A light beam 103 is emitted by light emitting means to a position of the charged surface of the electrostatic drum 101 on the downstream side in the rotational direction of the drum from a position in contact with the charging roller 102. The light emitting means is constituted by a semiconductor laser 104, which emits the light beam 103, a scanner 105, which scans the light beam 103 on the above-described surface and an optical lens 106 which controls the light beam 103 so as to form a light spot on the above-described surface. The light beam 103 is emitted based on image data, thereby forming a latent image on the above-described surface. The latent image is developed as a toner image by a developing device 107 in contact with the electrostatic drum 101 on the further downstream side in the rotational direction of the electrostatic drum 101 from the light-emitted position of the light beam 103.

The toner image is transferred onto paper P as a transfer material by a transfer roller 108 provided to be opposite to the electrostatic drum 101 below the drum. The paper P is set in a paper cassette 109 in front (on the right side in FIG. 1) of the electrostatic drum 101. However, the paper P can be manually fed to the printer. A paper-feed roller 110 is provided at an end of the paper cassette 109, and the paper-feed roller 110 sends the paper P in the paper cassette 109 to a conveyance path. Resist rollers 111 for correction of skewing of the paper P and synchronization between image formation on the electrostatic drum 110 and paper conveyance are provided in the middle of the conveyance path between the above-described paper-feed roller 110 and the transfer roller 108. The resist rollers 111 send the paper P to the above-described transfer position at a predetermined timing. Note that a resist-paper detection sensor 112 is provided between the resist rollers 111 and the paper-feed roller 110 such that the sensor detects the presence/absence of the paper P.

The paper P on which the unfixed toner image has been transferred is further conveyed to a fixing device in the rear (on the left side in FIG. 1) of the electrostatic drum 101. The fixing device is constituted with a fixing roller 113 including a fixing heater (not shown) and a pressing roller 114 in press-contact with the fixing roller 113. The paper P holding the transferred toner image is pressed and heated in a press-contact position between the fixing roller 113 and the pressing roller 114, thereby fixing the toner image onto the paper P. A discharged-paper detection sensor 115 which checks that the paper P is discharged from the press-contact position is provided in the rear of the press-contact position. Further, paper discharge rollers 116 are provided in the rear of the discharged-paper detection sensor 115. The paper P where the toner image has been fixed is discharged to a paper discharge tray 117 by the paper discharge rollers 116.

Next, the controller of the electrophotographic printer having the above mechanisms will be described with reference to FIG. 2. In FIG. 2, numeral 201 denotes a host computer provided outside the electrophotographic printer. The host computer sends image code data, generated by a user's operation or the like as parallel or serial data, through a communication line 202 to a controller 203. The controller 203 develops the image code data sent from the host computer 201 and thus converts the data to image information to be sent to the printer. Further, the controller 203 sends a command 217 to a printer controller 204, reads data inside the printer controller as a status 218, and makes a print start request and a preparatory paper-feed request to the printer controller. Further, the controller 203 controls a synchronizing signal for synchronization between image output timing and paper conveyance in the printer. The controller 203 exists in the printer or in the host computer. Further, the printer controller 204 is connected to an operation panel 205 for the user's various mode settings (e.g. image-area margin setting) of the printer.

The controller 203 connected to the host computer 201 performs data transmission/reception with the printer controller 204 as described above. The printer controller 204 is connected to a conveyance system driver 206, a high-pressure system driver 207, an optical system driver 208, a fixing heater controller 209 and a sensor input unit 210 for drive/stop timing control of the respective mechanisms in FIG. 1 and for reading information inputted from the respective sensors.

First, the conveyance system driver 206 performs drive/stop of various motors 211 and various rollers 212, and the high-pressure system driver 207 performs drive/stop of charging unit 213, the developing unit 214 and the transfer unit 215 based on instructions from the printer controller 204. Further, the optical system driver 208 performs drive/stop of the laser 104 and the scanner 105 based on instructions from the printer controller 204. Further, the fixing heater controller 209 performs drive/stop of the fixing heater 216 based on an instruction from the printer controller 204. The sensor input unit 210 reads information from the resist paper detection sensor 112 and the discharged-paper detection sensor 115 and provides the information to the printer controller 204.

Next, the operation of the apparatus of the present invention will be described. First, the printer is in a waiting status for a print-signal from the controller 203. If a print signal has not been received, the presence/absence of a preparatory paper-feed request from the controller 203 is checked. If a preparatory paper-feed request has been received, the motor 211 is driven, and then a paper-feed operation is started. Thereafter, it is checked whether or not the paper P arrives at the resist paper detection sensor 112. If the end of the paper is detected by the sensor 112, after a predetermined period of waiting, the paper-feed operation is stopped. At this time, the motor 211 is stopped and the printer returns to the print signal waiting status. When a print signal is received, the motor 211 is driven again, and at this time, the scanner 105 and the respective high-pressure units are started. When rotation of a scanner motor (not shown) has performed a predetermined number of revolutions, as the paper P has been already preparatorily fed, the resist paper detection sensor 112 checks the presence/absence of the paper P. At this time, if the paper P does not exist at the sensor 112, abnormality processing (jam processing or the like) is performed. Further, if the paper P exists at the sensor 112, a vertical synchronizing signal is outputted to the controller 203. Thereafter, when the vertical synchronizing signal is received, image writing to the electrostatic drum 101 is permitted, and the resist rollers 111 are driven. Then, after a predetermined period of waiting from detection of an end of the paper by the discharged-paper detection sensor 115, the high-pressure units and the scanner motor are stopped, then the roller driving system motors are stopped, and printing processing is stopped.

As shown in FIG. 1, the electrostatic drum 101 as an image holder, the charging roller 102 as a charging member to uniformly charge the surface of the electrostatic drum 101 and the developing device 107 as developing means for supplying toner as developing material to the electrostatic drum 101 are provided in, one unit, forming a removable cartridge 200.

Note that as units used for image formation, not only may the above arrangement be employed, but also a unit comprising the developing means 107 and the electrostatic drum 101, or a unit comprising only the developing means may be employed.

The cartridge 200 is provided with an EEPROM 219 as nonvolatile storage means. The EEPROM 219 holds information on the life of the cartridge 200, such as the drum-revolution accumulation time and the remaining amount of toner. The printer controller 204 of the apparatus main body determines the life of the cartridge 200 based on the information obtained by communication, and determines cancellation of the print signal from the controller 203 or the like.

Note that the unit cartridge 200 is removably attached to the image forming apparatus main body. When the cartridge 200 is attached to the image forming apparatus main body, data communication is possible between the EEPROM 219 and the printer controller 204 as shown in FIG. 2. Although not shown here, as a data communication method, communication by connector connection, radio communication or any other communication method can be used as long as it enables data transmission/reception with the nonvolatile memory such as an EEPROM.

Next, a method for efficiently using data areas of the nonvolatile memory, storing data related to image formation, such as data on the history of use and process conditions, in a process cartridge removably attached to the image forming apparatus main body using an electrophotographic process according to the present invention, will be described with reference to the drawings (FIGS. 3A to 3C, 4A, 4B and 5). The memory has a main buffer and a backup buffer. In data to be stored in the main buffer, bit information (data) is expanded to a lockable data size, while in data to be stored in the backup buffer, data locking is not performed but compressed in bit units and stored with originally-bit-unit other information into the backup buffer.

Figure 3A:
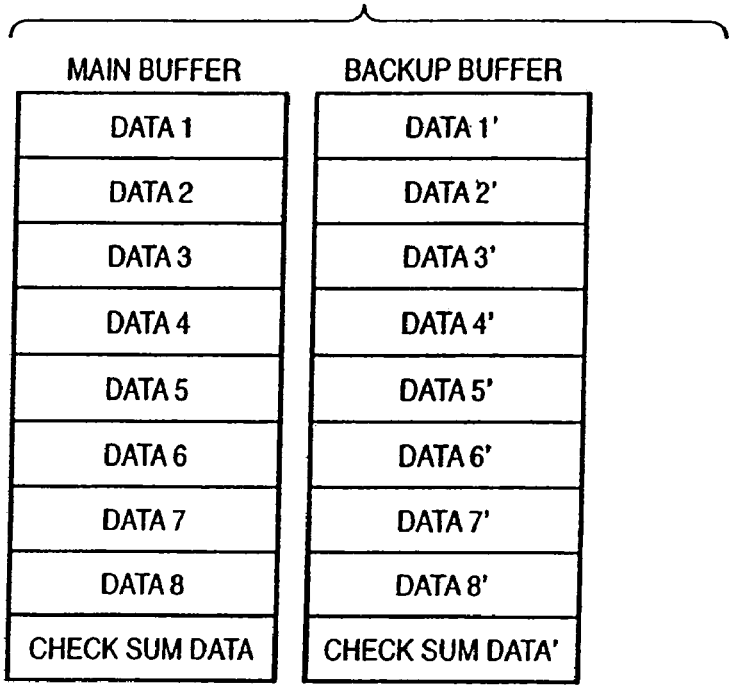
FIG. 3A PRIOR ART
FIGS. 3A to 3C are explanatory views schematically showing the allocation of data areas.
Figure 3B:
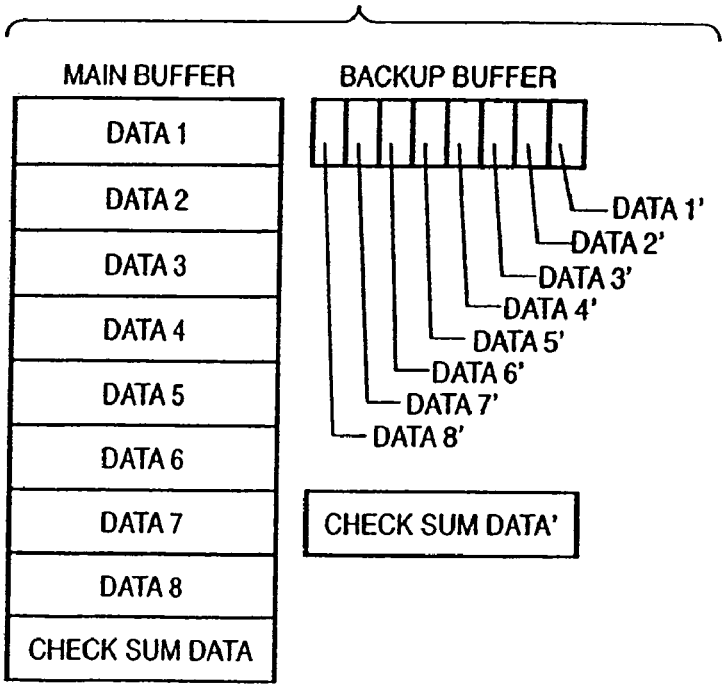

FIGS. 3A and 3B are explanatory views schematically showing the allocation of data areas in the EEPROM 219 in FIG. 2. First, a description will be provided about a case where 1-byte check sum information is held in the main buffer and the backup buffer. FIG. 3A shows data allocation in the conventional art. As shown in FIG. 3A, in a case where the minimum lockable data unit is 1 byte, 8 types of bit information are respectively expanded to 1 byte and allocated to respective data areas. In this example, an 8-byte data area and a 1-byte check sum data area are present in the main buffer. Similarly, in the backup buffer, an 8-byte data area and a 1-byte check sum data area are present. That is to store 8 bit data, a memory capable of storing 18 bytes is used.

On the other hand, FIG. 3B shows data allocation according to the present invention. As shown in FIG. 3B, the main buffer comprises an 8-byte data area and a 1-byte check sum data area as in the case of allocation in FIG. 3A. However, in the backup buffer, bit information (data) are handled in bit units, compressed with other bit information and stored in a 1-byte area. In this arrangement, the data size including the check sum in the backup buffer is 2 bytes.

The data size of the memory data area used in FIG. 3A is 18 bytes, whereas that used in FIG. 3B is 11 bytes. In comparison with FIG. 3A, about a 39% improvement is attained in the efficiency of use of the memory area is in FIG. 3B.

Figure 3C:
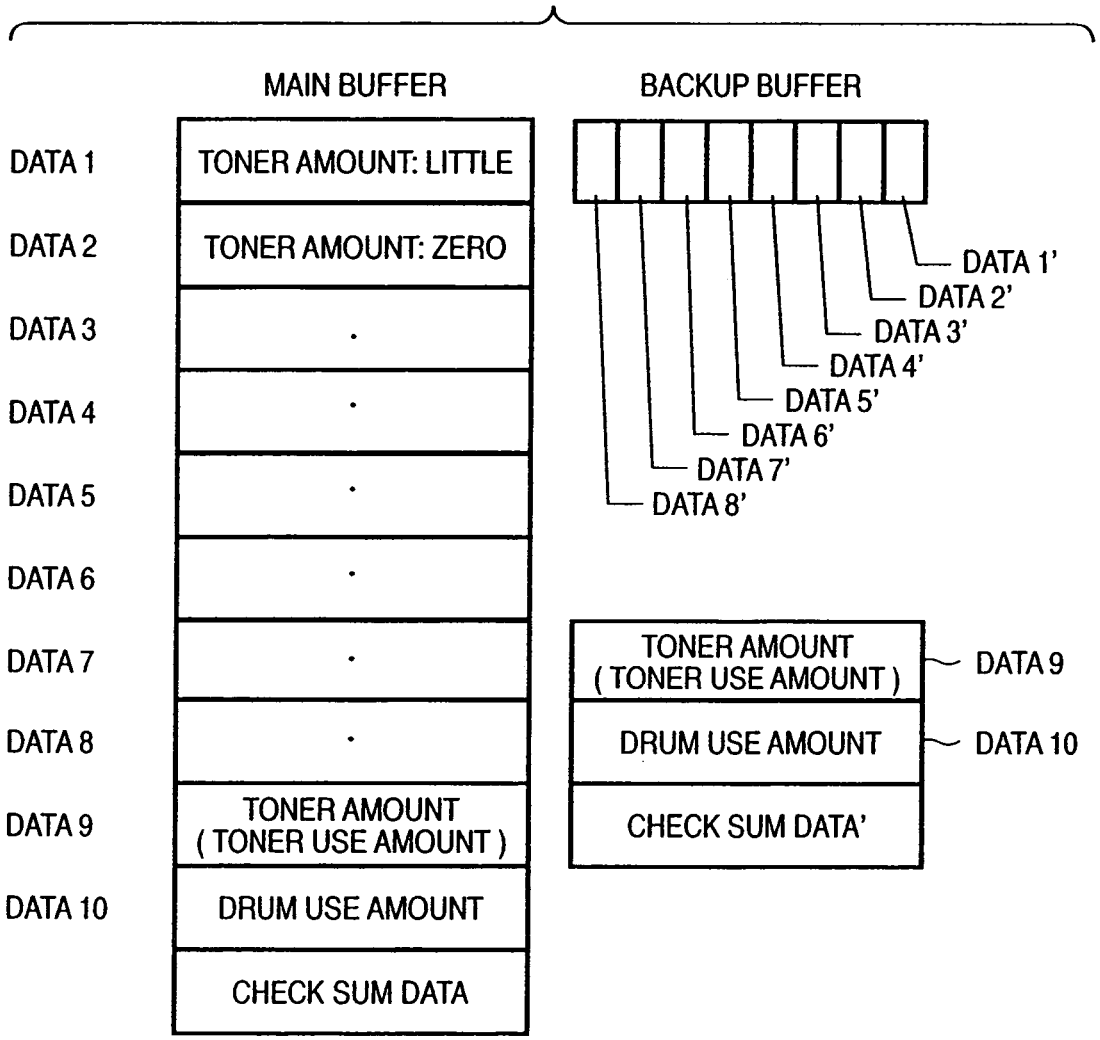

Note that FIG. 3C shows data stored in the EEPROM 219. The EEPROM 219 holds plural information, such as information indicating a status in which the remaining toner amount representing the history of use of the process cartridge is little or a status where the remaining toner amount is zero, or information on the toner use amount (the remaining toner amount in the developing device indicated by "g" or "%"), and information on the drum use amount (drum rotation time, the number of print sheets) other than the status information. The information indicating the statuses "toner amount: little", "toner amount: zero" (set/reset status) or the like is backed up in bit units, and the information on the toner use amount, the information on the drum use amount and the like other than the status information are backed up in byte units as in the case of information in the main buffer. That is, as shown in FIG. 3C, the backup buffer in the EEPROM 219 of the process cartridge has a bit-unit backup storage area and a byte-unit backup storage area.

Next, a method for recovery of memory status upon the occurrence of a data abnormality to a status close to the latest status will be described.

In a case where bit information is expanded to a data lockable minimum size, e.g., 1 byte, the expanded data has only 2 values, i.e., an arbitrary value indicating a set status of the bit information (data-written status) and an arbitrary value indicating a reset status of the bit information (data). If the expanded data has other value than the 2 values, it can be considered that an abnormality has occurred. Further, in an area to be locked after rewriting, data change means changing from a default value to a predetermined value (if the default value indicates the set status, the predetermined value indicates the reset status, while if the default value indicates the reset status, the predetermined value indicates the set status). In this case, the value after the data change has a significant meaning. That is, upon the occurrence of an abnormality, the data in the corresponding area becomes the predetermined value with probability 1/256 in the case of data expanded to 1 byte, and 1/65536 in the case of data expanded to 2 bytes. This means that even in a case where a check sum indicates an abnormality, if the expanded data indicates the predetermined value, the value of the buffer showing the abnormality can be used without a problem.

That is, in a case where a mechanism is known that causes data in an abnormality-occurred area to become "00h" or "FFh", the reliability can be further improved by avoiding "00h" or "FFh" (when expanded to 1 byte) as the predetermined value indicating a changed value from the bit information (data).

Accordingly, in a case where data is expanded to, e.g., 1 byte, even if a check sum abnormality has been determined regarding data in the main buffer, as long as the data of the main buffer has the predetermined value, the data value is used without recovery using a value in the backup buffer.

Figure 4A:
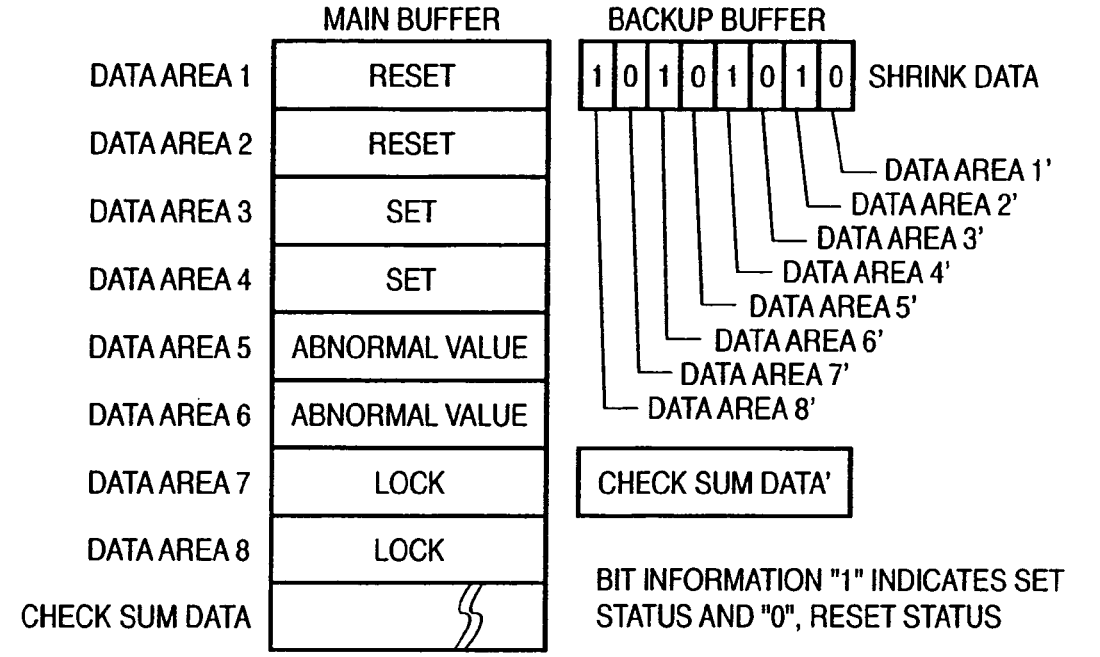
FIGS. 4A and 4B are explanatory views showing data recovery in the present invention.
Figure 4B:
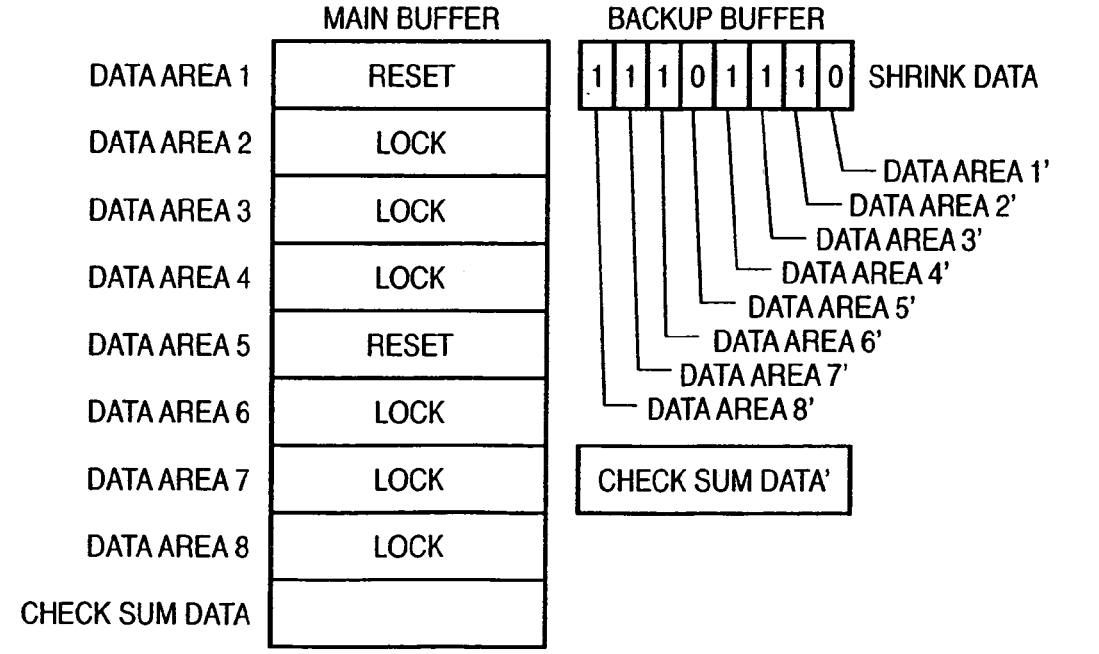

FIGS. 4A and 4B are explanatory views showing data recovery in the present invention. For the sake of simplification of explanation, each piece of data is changed from the reset status to the set status.

FIG. 4A shows statuses of the respective buffers and check sum data upon the occurrence of an abnormality. In this example, among the data areas 1 to 8 of the main buffer, the data areas 1 and 2 have a value indicating the reset status (hereinafter "reset status"), the data areas 3 and 4 have a value indicating the set status (hereinafter "set status"), the data areas 5 and 6 have an abnormal value (hereinafter "abnormal value") not indicating the "set status" nor the "reset status", and the data areas 7 and 8 have a value indicating the "set status" and these areas are further in a status where the data are locked (hereinbelow "locked status").

Note that in the main buffer, when the check sum (total sum) of the data areas 1 to 8 is calculated, a value stored in the check sum storage area and a calculated value do not correspond with each other. Further, in the backup buffer, information corresponding to the data areas 1 to 8 are alternately reset and set. When the check sum in the backup buffer is calculated, a stored value corresponds to a calculated value.

FIG. 5 is a flowchart showing data recovery processing according to the present invention. The control steps of the flowchart are executed by a program stored in a ROM (not shown) or the like in the printer controller 204 in FIG. 2.

First, at step S501, an index n indicating a data area of the main buffer and a bit area of the backup buffer is initialized to "1". Next, at step S502, it is determined whether or not the data area (n) of the main buffer is in the locked status. If it is not in the locked status, the process proceeds to step S503, at which it is determined whether or not the data area (n) of the main buffer is in the set status. If it is not in the set status, the process proceeds to step S504, at which it is determined whether or not the bit area (n) of the backup buffer is in the set status. If it is not in the set status, the process proceeds to step S505, at which the data area (n) of the main buffer is rewritten to the reset status. Next, at step S506, the check sum in the main buffer is calculated, and the data in the check sum storage area is rewritten.

In this manner, at steps S502 to S505, the data area (n) of the main buffer is in the reset status or shows the abnormal value and the bit area (n) of the backup buffer corresponds to the reset status. In the example of FIG. 4A, the reset status of the data area 1 and the abnormal value in the data area 5 are rewritten to the reset status as shown in FIG. 4B.

Further, at step S504, if the bit area (n) of the backup buffer is in the set status, the process proceeds to step S507, at which the data area (n) in the main buffer is rewritten to the set status. Next, at step S508, the check sum in the main buffer is calculated, and the data in the check sum storage area is rewritten. Then at step S509, the data area (n) of the main buffer is changed to the locked status.

In this manner, in the case of steps S504→S507, the data area (n) of the main buffer is in the reset status or shows the abnormal value, and the bit information in the bit area (n) of the backup buffer corresponds to the set status. In the example of FIG. 4A, the reset status of the data area 2 and the abnormal value in the data area 6 are rewritten to the set status, and further, these areas are respectively rewritten to the locked status as shown in FIG. 4B.

Further, at step S503, if the data area (n) of the main buffer is in the set status, the process proceeds to step S510, at which the data area (n) of the main buffer is changed to the locked status. Next, at step S511, the check sum in the main buffer is calculated, and the data in the check sum storage area is rewritten. Then at step S512, the bit area (n) of the backup buffer is rewritten to the set status. Next, at step S513, the check sum in the backup buffer is calculated, and data in the check sum storage area is rewritten.

In this manner, in the case of steps S503→S510, the data area (n) of the main buffer corresponds to the set status. In the example of FIG. 4A, the set status of the data area 3 and the data area 4 are respectively rewritten to the locked status as shown in FIG. 4B. Then bit information in the bit area 3 of the backup buffer is rewritten to the set status.

Further, at step S502, if the data area (n) of the main buffer is in the locked status, the process proceeds to step S516, at which it is determined whether or not the data area (n) of the main buffer is in the set status. If the data area (n) of the main buffer is not in the set status, it is determined that the memory cannot be recovered. That is, in the present embodiment, the data in the main buffer is changed to the locked status only at steps S509 and S510 since the data in the main buffer is in the set status. Further, if the data area (n) of the main buffer is in the set status, the process proceeds to step S511, to perform the above-described processing.

In this manner, in the case of steps S502→S516, the data area (n) of the main buffer corresponds to the locked status. In the example of FIG. 4A, the data area 7 and the data area 8 are in the locked status. As shown in FIG. 4B, bit information in the bit area 7 of the backup buffer is rewritten to the set status.

Next, when the above-described processing has been completed, the index n is updated at step S514, and at step S515, it is determined whether or not all the recovery operation has been completed. If the recovery has been completed, the process ends, while if the recovery operation has not been completed, the process returns to step S502, to repeat the above-described processing.

In a case where the check sum in the main buffer does not correspond with a calculated value but the check sum in the backup buffer corresponds with a calculated value, data recovery is performed in accordance with the following rules.

(1) Recovery is performed basically using a value in the backup buffer. When a value in the main buffer is changed to the set status, data locking is also performed. Note that this processing is performed except in the following cases:

(2) If the value in the main buffer indicates the set status, the data in the backup buffer is changed to the set status. The value in the main buffer is locked.

(3) If the value in the main buffer indicates the locked status, the data in the backup buffer is changed to the set status.

[First Embodiment]

Next, a first embodiment of the present invention will be described in detail with reference to the drawings (FIGS. 6A–6B, 8 and 9).

Figure 6A:
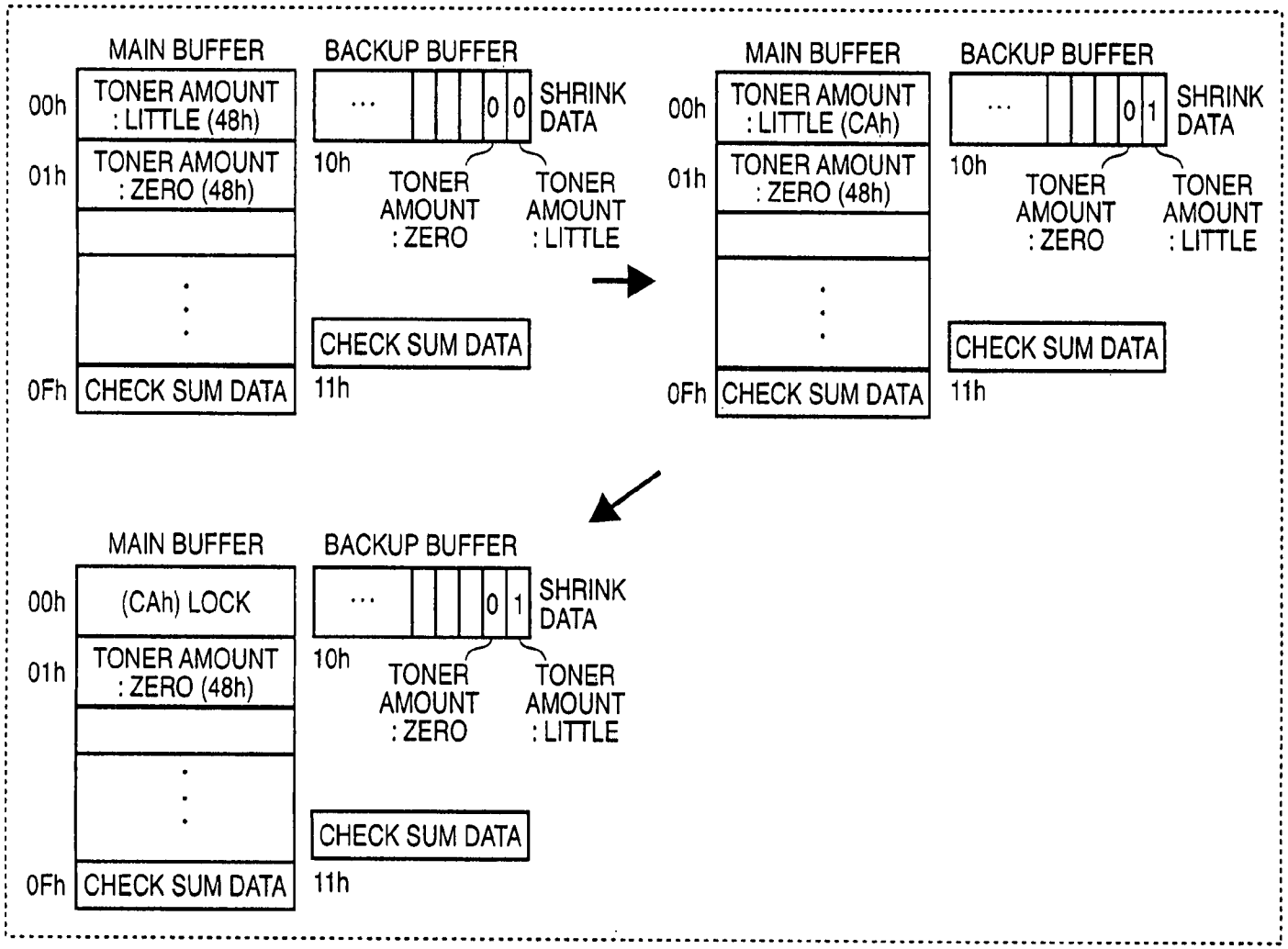
FIGS. 6A and 6B are explanatory views showing processing according to a first embodiment.
Figure 6B:
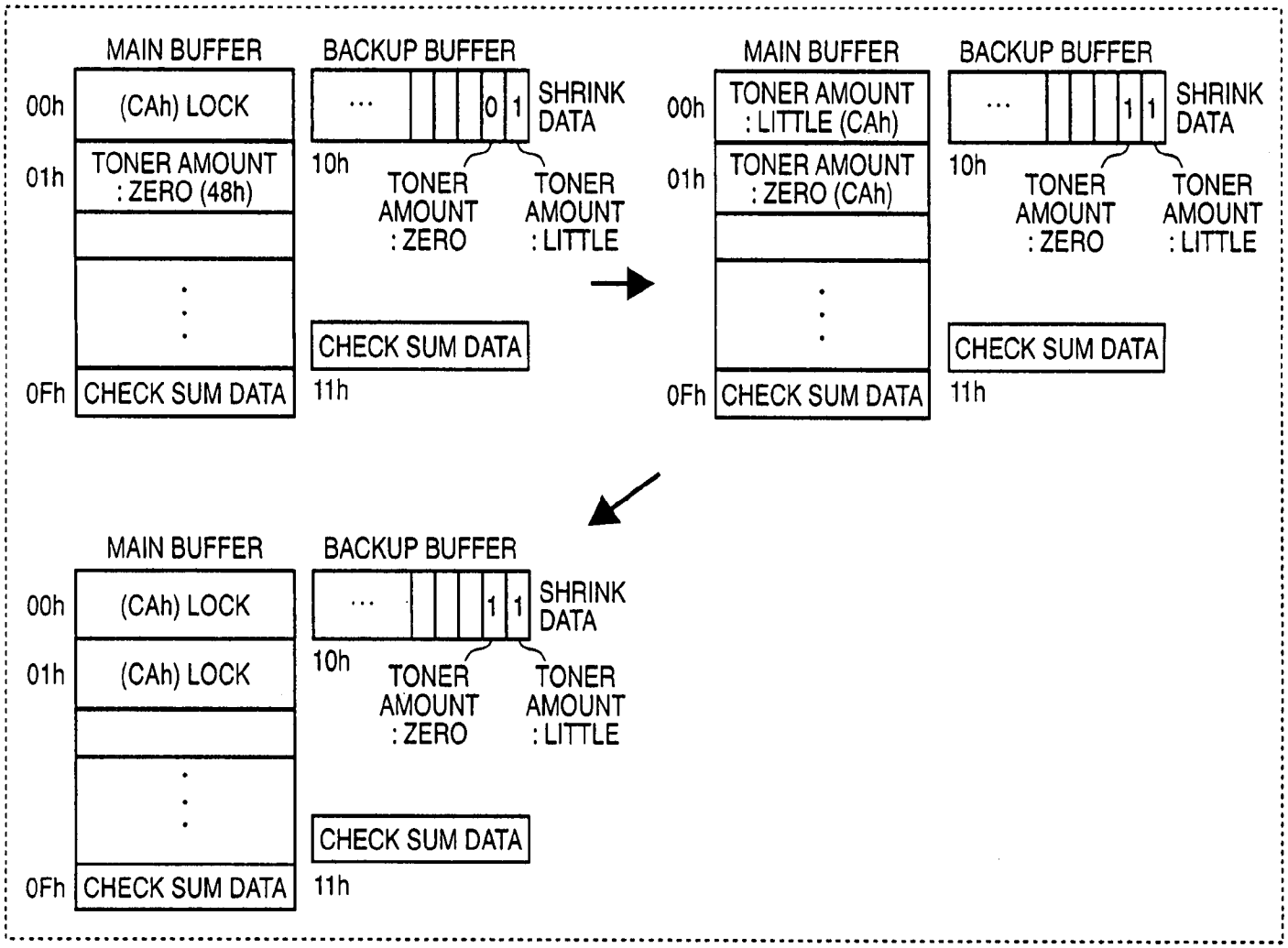

FIGS. 6A and 6B are explanatory views showing processing according to the first embodiment. In the first embodiment, a data area of the memory provided inside the process cartridge is a 256 byte area indicated with addresses 00h to FFh. Data rewriting can be disabled in 1-byte units. Further, as bit information (data) stored in the memory, "toner amount: little" indicating that the remaining developing material in the process cartridge has been reduced, and "toner amount: zero" indicating that the developing material has been exhausted are used.

As shown in FIG. 6A, in one buffer of the double buffer structure as the main buffer, to disable data rewriting by bit information (data), "toner amount: little" is allocated to the area at the address 00h and "toner: zero" is allocated to the area at the address 01h for storage in 1 byte units in correspondence with the rewrite-disable minimum data size, 1 byte. Further, byte information indicating the reset status of arbitrarily-set bit information (data) is "48h", and byte information indicating the set status is "CAh".

In the other buffer of the double buffer structure as the backup buffer, 2 bit information (data) "toner amount: little" and "toner amount: zero" are compressed and allocated to one area at the address 10h. The most significant bit of the area at the address 10h indicates "toner amount: little", and the next most significant bit indicates "toner amount: zero". Further, a value "1" of the bit information (data) indicates the set status, and "0", the reset status.

In a new process cartridge, as the information "toner amount: little" and "toner amount: zero" are in the reset status, data in the memory at the address 00h is "48h" indicating the reset status, data at the address 0h1 is "48h" indicating the reset status, the most significant bit at the address 10h as compressed information is "0", and the next most significant bit is "0".

As the process cartridge is used, the amount of the developing material is reduced, and if it is determined that the cartridge has changed its status to "toner amount: little" when the amount of the developing material is equal to or less than a predetermined amount, the data in the memory at the address 00h becomes "CAh" indicating the set status, the data at the address 01h, is "48h" the reset status, the most significant bit at the address 10h as the compressed information is "1", and the next most significant bit at the address 10h is "0". The data at the address 00h is locked, thus disabling rewriting.

As the process cartridge is further used, the developing material is continuously reduced, and if it is determined that the cartridge has changed its status to "toner amount: zero" when the amount of developing material is equal to or less than another predetermined amount, the data in the memory at the address 00h is still "CAh" indicating the set status, the data at the address 01h becomes "CAh" indicating the set status, the most significant bit at the address 10h as the compressed information is still "1", and the next most significant bit becomes "1". The data at the address 01h is locked, thus disabling rewriting.

[Check Sum]

The respective buffers of the double buffer structure hold check sum data as error check means. The check sum data of the main buffer is stored in the area at the address 0Fh, and the check sum data of the backup buffer is stored in the area at the address 11h. When the data representing the states "toner amount: little" or "toner amount: zero" stored in the main buffer is changed, the check sum data of the main buffer is rewritten to a value calculated by check sum calculation means after rewriting of the data in the main buffer. When the bit information (data) "toner amount: little" and "toner amount: zero" stored in the area at the address 10h allocated to the backup buffer are rewritten, the check sum in the backup buffer is rewritten to a value calculated by the check sum calculation means.

If it is detected that power has been turned on or the process cartridge has been exchanged with a new one, the image forming apparatus reads all the values in the data area in the memory, and determines whether or not the check sum data stored in the check sum data areas of the respective buffers correspond with check sum values (obtained by adding up read values) calculated by the check sum calculation means in the printer controller 204. If one of the check sums does not correspond with the calculated check sum in one of the buffers, the other check sum data is compared with the calculated value. As a result, if the other check sum does not correspond with the calculated value, the memory data cannot be recovered. However, if the other check sum corresponds with the calculated value, the data of the memory can be recovered by using the data in the buffer where the check sum corresponds with the calculated value. That is, in the case of a double buffer having the above-described structure where the check sum does not correspond with the calculated value in the main buffer, data recovery is performed in accordance with the following procedure.

Figure 8:
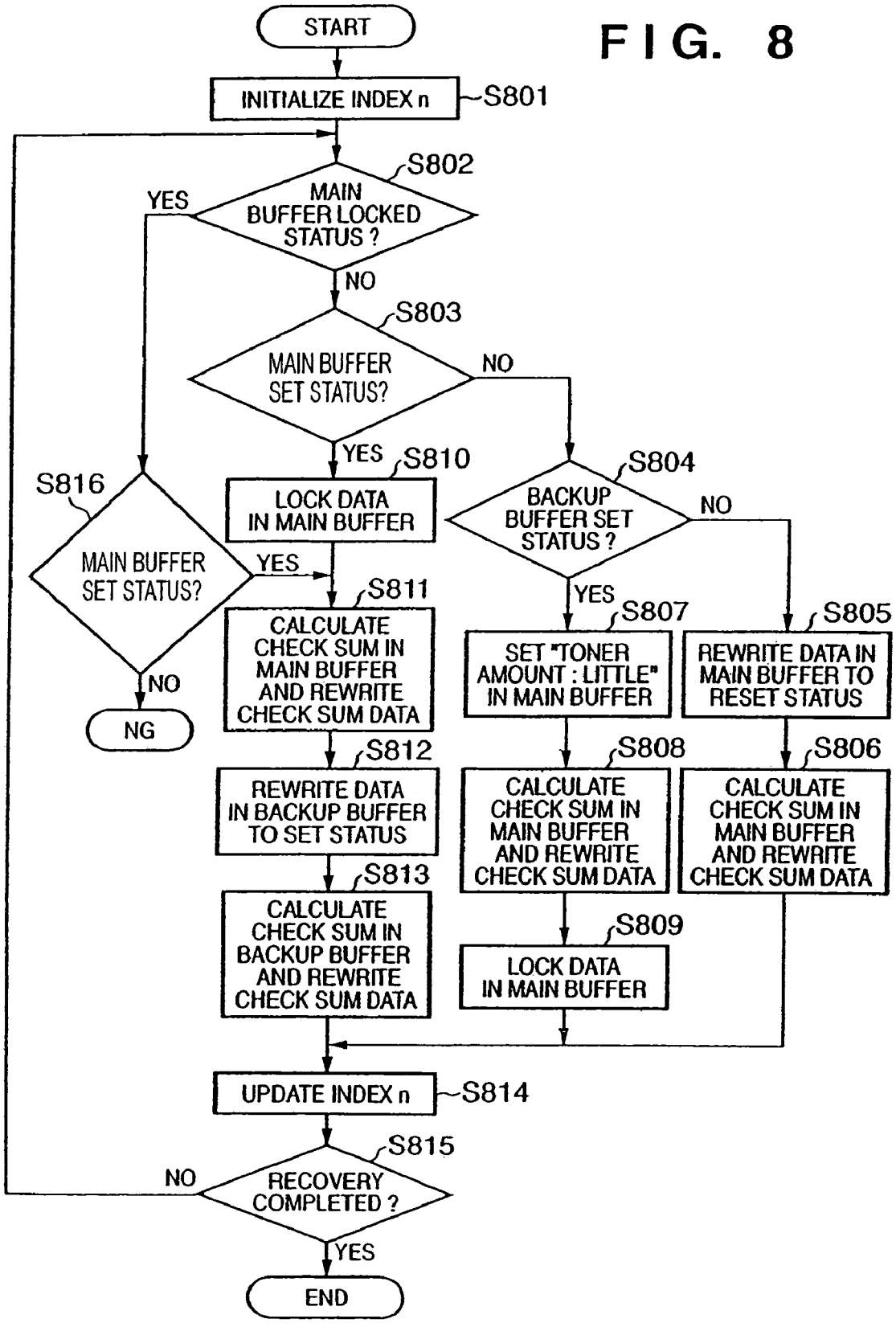
FIG. 8 is a flowchart showing the data recovery processing according to the first embodiment.
Figure 9:
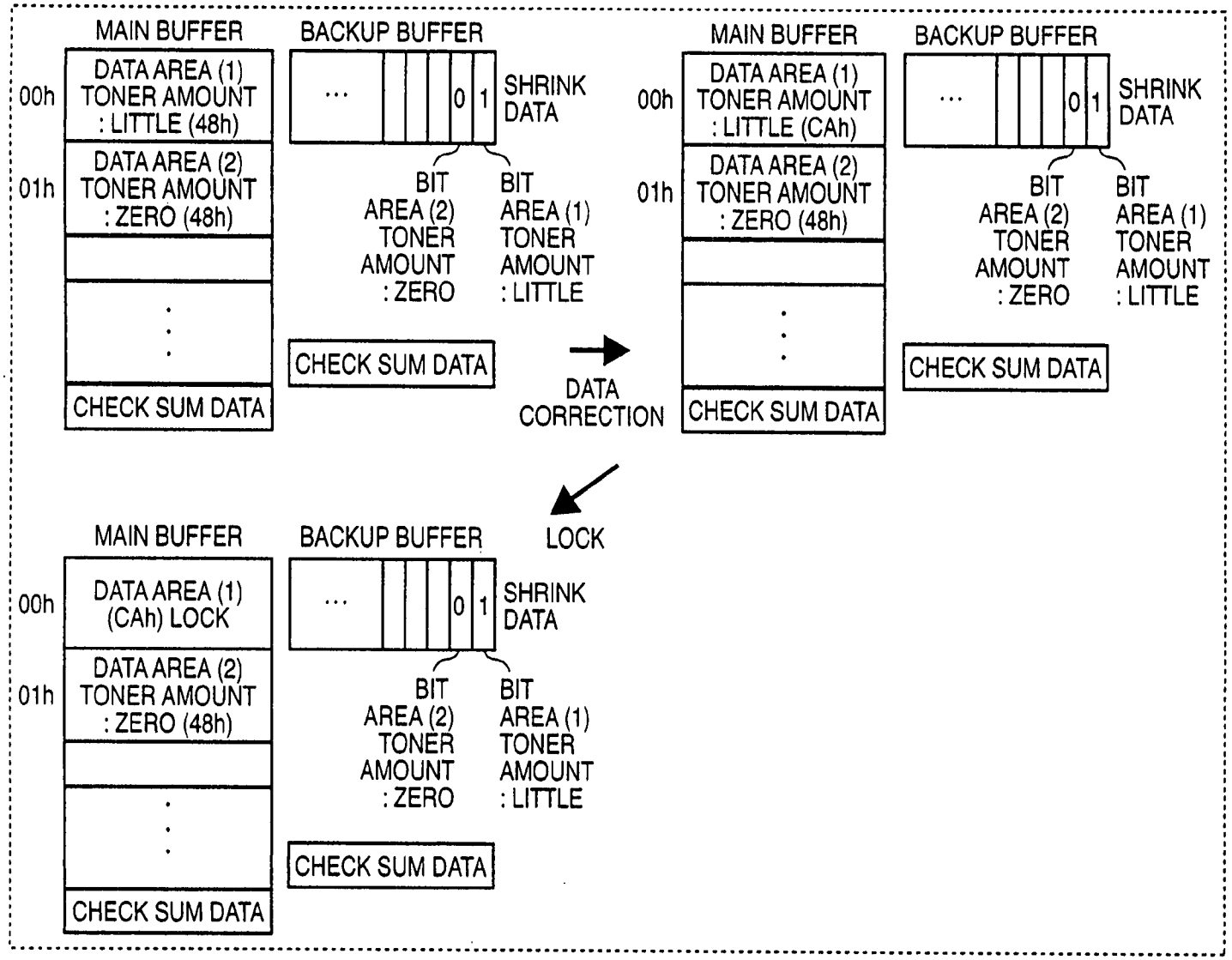
FIG. 9 is an explanatory view showing an example of data correction and data locking in a main buffer and a backup buffer.
Figure 10:
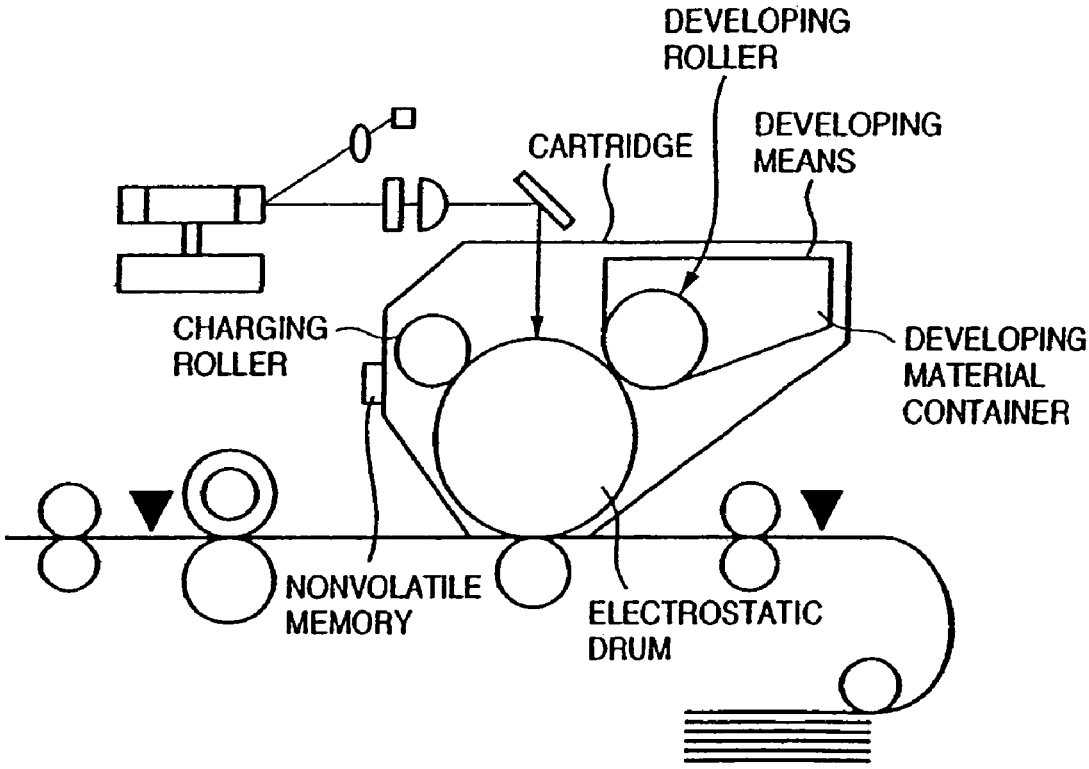
FIG. 10 PRIOR ART
FIG. 10 is a schematic cross-sectional view showing the structure of the laser printer using the electrophotographic technology.

FIG. 8 is a flowchart showing the data recovery processing according to the first embodiment. FIG. 9 is an explanatory view showing an example of data correction and data locking in main buffer and a backup buffer.

First, at step S801, the index n indicating the data area (n) of the main buffer and the bit area (n) of the backup buffer is initialized to "1". Next, at step S802, it is determined whether or not the data area (1) of the main buffer is in the locked status. If it is not in the locked status, the process proceeds to step S803, at which it is determined whether or not "48h" is set in the data area (1) at the address 00h of the main buffer. If it is not in the set status, the process proceeds to step S804, at which it is determined whether or not the bit area (1) of the backup buffer is in the set status. If it is not in the set status, the process proceeds to step S805, at which the data area (1) at the address 00h of the main buffer is rewritten to the reset status. Next, at step S806, the check sum in the main buffer is calculated, and the data in the check sum storage area is rewritten.

In this manner, at steps S802 to S806, the data area (1) at the address 00h of the main buffer is in the reset status or shows an abnormal value and the bit information in the bit area (1) of the backup buffer corresponds to the reset status. In this case, the data in the data area (1) at the address 00h of the main buffer is rewritten to the reset status (00h). Next, the check sum in the main buffer is calculated, and the data in the check sum storage area is rewritten.

Further, at step S804, if the bit information in the bit area (1) of the backup buffer is in the set status, the process proceeds to step S807, at which the data area (1) at the address 00h in the main buffer is rewritten to the set status (CAh). Next, at step S808, the check sum in the main buffer is calculated, and the data in the check sum storage area is rewritten. Then at step S809, the data area (1) at the address 00h of the main buffer is changed to the locked status.

In this manner, in the case of steps S804→S807, the data area (1) at the address 00h of the main buffer is in the reset status or shows an abnormal value, and the bit information in the bit area (1) of the backup buffer corresponds to the set status. In this case, the data in the data area (1) at the address 00h of the main buffer is rewritten to the set status (CAh), and further, the date at the address 00h area is rewritten to the locked status.

FIG. 9 shows an example of the statuses of main buffer and the backup buffer in the case of steps S804→S807.

Further, at step S803, if the data area (1) at the address 00h of the main buffer is in the set status, the process proceeds to step S810, at which the data area (1) at the address 00h of the main buffer is changed to the locked status. Next, at step S811, the check sum in the main buffer is calculated, and the data in the check sum storage area is rewritten. Then at step S812, the bit area (1) of the backup buffer is rewritten to the set status. Next, at step S813, the check sum in the backup buffer is calculated, and data in the check sum storage area is rewritten.

In this manner, in the case of steps S803→S810, the data area (1) at the address 00h of the main buffer corresponds to the set status. In this case, the bit information in the bit area (1) of the backup buffer is rewritten to the set status.

Further, at step S802, if the data area (1) at the address 00h of the main buffer is in the locked status, the process proceeds to step S816, at which it is determined whether or not the data area (1) at the address 00h of the main buffer is in the set status. As a result, if the data area (1) at the address 00h of the main buffer is not in the set status, it is determined that the memory cannot be recovered. That is, in the present embodiment, the data in the main buffer is changed to the locked status only at steps S809 and S810 since the data in the main buffer is in the set status (CAh). Further, if the data area (1) at the address 00h of the main buffer is in the set status, the process proceeds to step S811, to perform the above-described processing.

In this manner, in the case of steps S802→S816, the data area (1) of the main buffer corresponds to the locked status. In this case, it is determined whether or not the data area (1) at the address 00h of the main buffer is in the set status. If it is not in the set status, it is determined that recovery is impossible (NG).

Next, when the above-described processing has been completed, the index n initialized at step S801 (n=1) is updated (n=2) at step S814. Then at step S815, it is determined whether or not all the recovery has been completed. If the recovery has been completed, the process ends, while if the recovery has not been completed, the process returns to step S802, to repeat the above-described processing.

In accordance with the above procedure, data recovery which reflects further latest information can be performed.

The above means can be realized in the form of program set on a microcomputer on the controller.

[Second Embodiment]

Figure 7A:
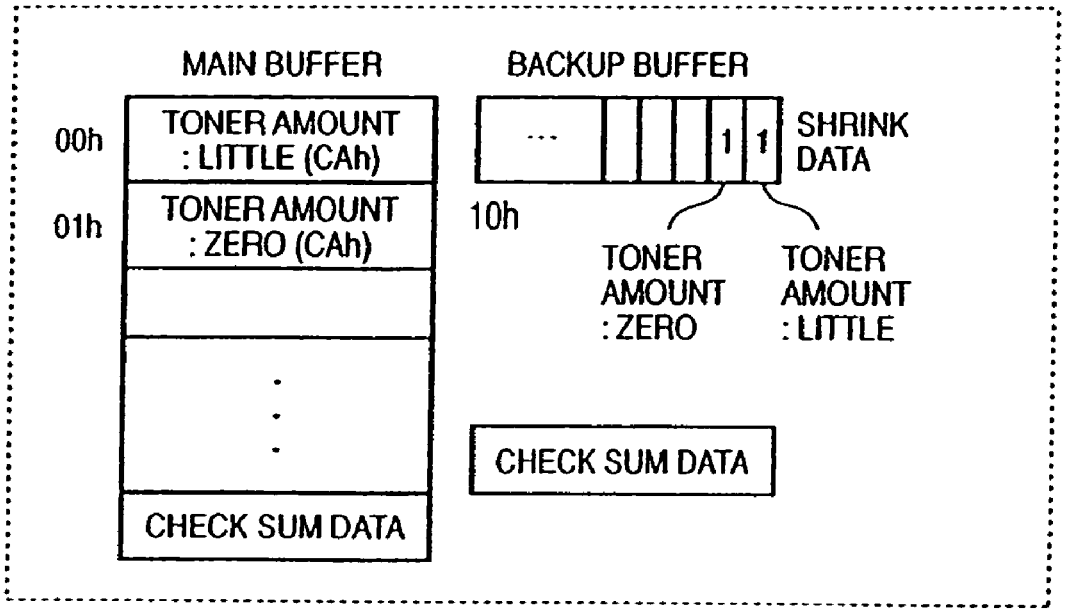
FIGS. 7A and 7B are explanatory views showing processing according to a second embodiment of the present invention.
Figure 7B:
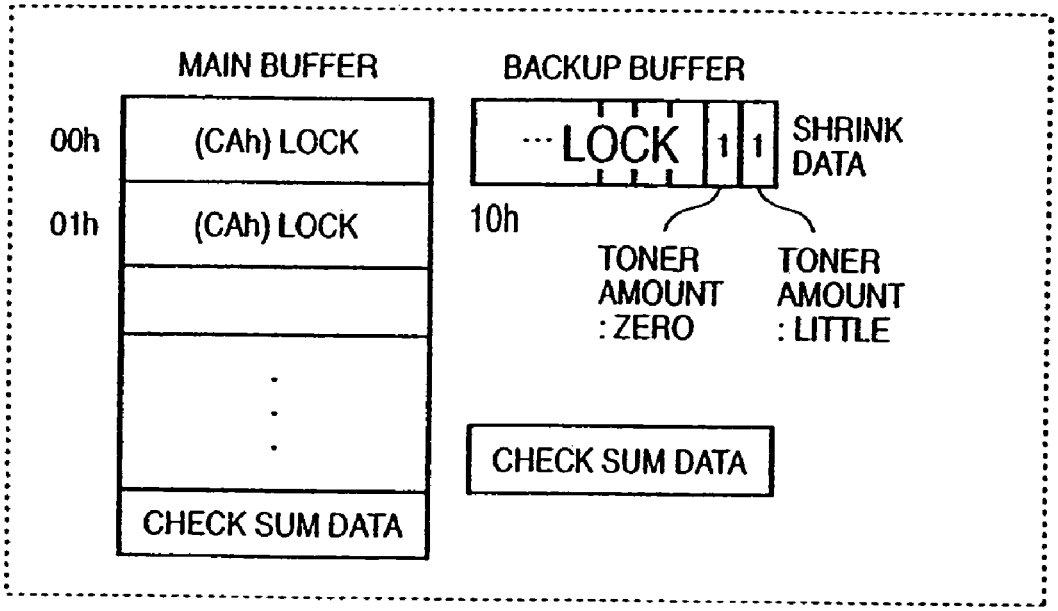

Next, a second embodiment of the present invention will be described in detail with reference to the drawings (FIGS. 7A and 7B).

As the data structure of the memory mounted on the process cartridge according to the second embodiment is the same as that of the first embodiment, only the differences from the first embodiment will be described here.

FIGS. 7A and 7B are explanatory views showing processing according to the second embodiment. As shown in FIG. 7A, the information representing the states "toner amount: little" and "toner amount: zero" are set, respectively, at the addresses 00h and 01h corresponding to the main buffer. At this time, the compressed data representing the states "toner amount: little" and "toner amount: zero" are set at address 10h in the backup buffer for storing corresponding compressed data in the backup buffer. In this status, as shown in FIG. 7B, the data at the address 00h, the address 01h and the compressed data at the address 10h of the backup buffer are locked, thus disabling rewriting.

Note that regarding the check sum, it is handled in the same manner as that in the first embodiment, therefore, the explanation thereof will be omitted.

In the first and second embodiments, as data stored in the memory provided inside the cartridge, the data representing the states "toner amount: little" and "toner amount: zero" are used. However, the data are not limited to these data and cartridge data such as the number of printing operations using the cartridge or information indicating whether or not the cartridge is a new article, or the like, may be used.

As described above, according to the embodiments, memory data areas can be efficiently used. Further, as plural information can be obtained at once by accessing a one bit address, the number times the memory is accessed can be reduced. Further, appropriate data recovery can be realized.

The present invention can be applied to a system constituted by a plurality of devices (e.g., a host computer, an interface, a reader and a printer) or to an apparatus comprising a single device (e.g., a copy machine or a facsimile apparatus).

Further, the object of the present invention can also be achieved by providing a storage medium (or recording medium) holding software program code for performing the aforesaid functions according to the embodiments to a system or an apparatus, reading the program code with a computer (e.g., CPU, MPU) of the system or apparatus from the storage medium, and then executing the program.

In this case, the program code read from the storage medium realizes the functions according to the embodiments, and the storage medium holding the program code constitutes the invention.

Further, the storage medium, such as a floppy disk, a hard disk, an optical disk, a magnetic-optical disk, a CD-ROM, a CD-R, a DAD, a magnetic tape, a non-volatile type memory card, and ROM can be used for providing the program code.

Furthermore, besides aforesaid functions according to the above embodiments are realized by executing the program code which is read by a computer, the present invention includes a case where an OS (operating system) or the like working on the computer performs a part or the entire actual processing in accordance with designations of the program code and realizes functions according to the above embodiments.

Furthermore, the present invention also includes a case where, after the program code red from the storage medium is written in a function expansion card which is inserted into the computer or in a memory provided in a function expansion unit which is connected to the computer, the CPU or the like contained in the function expansion card or unit performs a part or the entire actual processing in accordance with designations of the program code and realizes functions of the above embodiments.

As described above, according to the present invention, memory data areas can be efficiently used. Further, in a case where an abnormality occurs in the memory, the status of the memory can be recovered to a status close to the latest status.

The present invention is not limited to the above embodiments and various changes and modifications can be made within the spirit and scope of the present invention. Therefore, to appraise the public of the scope of the present invention, the following claims are made.

What is claimed is:

1. A storage control method for a memory, provided in a cartridge removably attached to an image forming apparatus, having a first storage area for storing data relating to the cartridge and a second storage area used for backing up the data stored in the first storage area, the storage capacity of the second storage area being smaller than the storage capacity of the first storage area, said method comprising:

a step of writing first data relating to the condition of the cartridge to the first storage area; and a step of writing second data to a predetermined area in the second storage area, corresponding to the first storage area in a case where the first data has been written to the first storage area.

2. The method according to claim 1, further comprising:

a step of setting the first storage area to a writing-disabled status after the first data has been written to the first storage area; and a step of setting the second storage area to a writing-disabled status in a case where data has been written to all areas in the second storage area.

3. The method according to claim 1, further comprising:

a step of determining whether the first storage area is set in a writing-disabled status; and a step of writing second data to the predetermined area in the second storage area in a case where said determining step determines that the first storage area is set in the writing-disabled status.

4. The method according to claim 1, further comprising:

a step of determining whether the first data stored in the first storage area has an abnormal value; and a step of rewriting the first data stored in the first storage area based on the second data stored in the predetermined area in the second storage area in a case where said determining step determines that the first data stored in the first storage area has the abnormal value.

5. The method according to claim 1, wherein the memory further has a third storage area usable for backing up the first data stored in the first storage area, and wherein the method further comprises a step of writing third data to the third storage area in a case where the first data stored in the first storage area is not predetermined data.

6. The method according to claim 5, wherein the predetermined data is data indicating whether or not the cartridge is a new product, or data relating to the remaining amount of developing material stored in the cartridge.

* * * * *

UNITED STATES PATENT AND TRADEMARK OFFICE

CERTIFICATE OF CORRECTION

PATENT NO. : 7,050,727 B2
APPLICATION NO. : 11/201315
DATED : May 23, 2006
INVENTOR(S) : Hiroshi Chihara It is certified that error appears in the above-identified patent and that said Letters Patent is hereby corrected as shown below:

COVER PAGE AT ITEM [56] RC:
Foreign Patent Documents:

"09190137 A" should read --09-190137 A--.
"10052964 A" should read --10-052964 A--.
"11031107 A" should read --11-031107 A--.
"2001195313 A" should read --2001-195313 A--.
"2002067449 A" should read --2002-067449 A--.

COLUMN 7:
Line 21, "value" should read --values--.

COLUMN 10:
Line 31, "states" should read --statuses--.

COLUMN 11:
Line 36, "date" should read --data--.

COLUMN 12:
Line 30, "states" should read --statuses--.
Line 34, "states" should read --statuses--.
Line 45, "states" should read --statuses--.

Signed and Sealed this

Third Day of February, 2009

JOHN DOLL
*Acting Director of the United States Patent and Trademark Office*